US005373817A

United States Patent [19]

Schechter et al.

[11] Patent Number: 5,373,817

[45] Date of Patent: Dec. 20, 1994

[54] VALVE DEACTIVATION AND ADJUSTMENT SYSTEM FOR ELECTROHYDRAULIC CAMLESS VALVETRAIN

[75] Inventors: Michael M. Schechter, Farmington Hills; Michael B. Levin, Birmingham, both of Mich.

[73] Assignee: Ford Motor Company, Dearborn, Mich.

[21] Appl. No.: 168,343

[22] Filed: Dec. 17, 1993

[51] Int. Cl.[5] ..... F01L 9/02

[52] U.S. Cl. ..... 123/90.12; 123/90.15

[58] Field of Search ..... 123/90.11, 90.12, 90.13, 123/90.15, 198 F

[56] References Cited

U.S. PATENT DOCUMENTS

| | | | |
|---|---|---|---|
| 2,915,052 | 12/1959 | Gullen | 123/90.11 |
| 3,209,737 | 10/1965 | Omotehara et al. | 123/90.12 |
| 3,240,191 | 3/1966 | Wallis | 123/478 |
| 3,361,121 | 1/1968 | Schott | 123/90.13 |
| 3,534,718 | 10/1970 | Pacquin | 123/90.13 |
| 3,741,176 | 7/1973 | Schmidt et al. | 123/90.12 |
| 3,926,159 | 12/1975 | Michelson et al. | 123/90.11 |
| 3,935,846 | 2/1976 | Zelenka | 123/117 R |
| 3,963,006 | 6/1976 | Firey | 123/90.12 |
| 4,200,067 | 4/1980 | Trenne | 123/90.12 |
| 4,296,911 | 10/1981 | Escobosa | 123/90.12 |
| 4,572,114 | 2/1986 | Sickler | 123/90.13 |
| 4,614,170 | 9/1986 | Pischinger et al. | 123/90.11 |
| 4,706,619 | 11/1987 | Buchl | 123/90.11 |
| 4,716,862 | 1/1988 | Saure | 123/90.12 |
| 4,791,895 | 12/1988 | Tittizer | 123/90.12 |
| 4,794,891 | 1/1989 | Knobloch | 123/90.11 |
| 4,821,689 | 4/1989 | Tittizer et al. | 123/90.12 |
| 4,823,825 | 4/1989 | Buchl | 123/90.11 |
| 4,887,562 | 12/1989 | Wakeman | 123/90.12 |
| 4,930,464 | 6/1990 | Letsche | 123/90.12 |
| 4,930,465 | 6/1990 | Wakeman et al. | 123/90.12 |
| 4,957,075 | 9/1990 | Hasegawa | 123/90.12 |
| 4,960,083 | 10/1990 | Seki et al. | 123/90.16 |
| 4,974,495 | 12/1990 | Richeson, Jr. | 123/90.12 |
| 4,995,351 | 2/1991 | Ohkubo et al. | 123/90.11 |
| 5,099,806 | 3/1992 | Murata et al. | 123/198 F |
| 5,197,419 | 3/1993 | Dingess | 123/90.13 |
| 5,231,959 | 8/1993 | Smietana | 123/90.12 |
| 5,255,641 | 10/1993 | Schechter | 123/90.11 |
| 5,263,441 | 11/1993 | Rembold et al. | 123/90.12 |
| 5,275,136 | 1/1994 | Schechter et al. | 123/90.12 |

*Primary Examiner*—E. Rollins Cross
*Assistant Examiner*—Weilun Lo
*Attorney, Agent, or Firm*—Donald A. Wilkinson; Roger L. May

[57] ABSTRACT

A electrohydraulic engine valve control system in a four valve per cylinder engine wherein each of pair of intake and/or exhaust valves in each cylinder is hydraulically controlled by a separate set of solenoid valves. Each engine valve includes a piston subjected to fluid pressure acting on surfaces at both ends with the volume at one end connected to a source of high pressure fluid while a volume at the other end is selectively connected to a source of high pressure fluid and a source of low pressure fluid, and disconnected from each through action of the solenoid valves. Each pair of corresponding valves is linked hydraulically together and my be moved in unison or one may have reduced travel relative to the other via a valve deactivator, including one valve being completely deactivated. This difference in travel between the pair of valves accounts for various engine operating conditions and manufacturing tolerances. Equal air delivery to all engine cylinders having the aforementioned variable valve control system is assured by controlling electric pulses of variable duration and timing along with actuation of the valve deactivator.

10 Claims, 2 Drawing Sheets

VALVE DEACTIVATION AND ADJUSTMENT SYSTEM FOR ELECTROHYDRAULIC CAMLESS VALVETRAIN

FIELD OF THE INVENTION

The present invention relates to systems for variably controlling internal combustion engine intake and exhaust valves. More specifically, it relates to camless engine valve systems in four valve engines used to variably control the engine valve motion.

BACKGROUND OF THE INVENTION

The enhancement of engine performance that can be attained by varying the valve timing and lift as well as the acceleration, velocity and travel time of the intake and exhaust valves in an engine is well known and appreciated in the art. Many engines today employ four valves per cylinder, i.e., 2 intake and two exhaust valves, to improve overall engine performance, especially at medium to high speed. On the other hand, when a four-valve engine is operated at low speed, it may be desirable to deactivate one of the two intake valves to increase the velocity of air entering the combustion cheer, in order to improve swirl. Thus, a valve system should include a valve deactivator that can deactivate one of the two intake valves and then reactivate it again when necessary, to achieve optimum performance.

Further, even with exhaust valves, it is sometimes desirable to have just one exhaust valve operating at low engine speeds. This may reduce the hydraulic power consumed in valve movement and thus reduce the energy loss by only moving one instead of two valves. Therefore, the ability to deactivate one of two intake (or exhaust) valves is a highly desirable feature in a four valve engine.

In a four valve engine with an electrohydraulic valve train that independently controls each valve, valve deactivation can be performed by terminating the signals going to the control means. In four valve engines, however, independently controlling each engine valve with separate hydraulic valve controls is expensive and can require excessive space. Even so, it is still desirable to be able to independently control each engine valve to account for the various engine operating conditions.

To reduce the number of hydraulic valve controls, the pair of intake valves in each cylinder can be coupled together and operated with the same hydraulic valves and controls; as well, the pair of exhaust valves in each cylinder can be similarly coupled together. An object, of the present invention, is to activate each pair of valves with substantially the same lift and timing for most engine operating conditions. But this is not always possible because of slight differences, that arise due to tolerances in manufacturing, between each valve in a pair.

The need, then, arises for an electrohydraulic valvetrain that will work in a four valve engine to ensure substantially identical lift and timing of each pair of valves when necessary, and will also allow one valve from each pair to be either partially or wholly deactivated when certain engine conditions make it desirable to do so while not requiring separate independent controls for each engine valve in the valvetrain.

SUMMARY OF THE INVENTION

In its embodiments, the present invention contemplates, in combination, a pair of electrohydraulically actuated engine valves within a cylinder of a four valve engine coupled to a valve control system having a high pressure actuation valve and a low pressure actuation valve, and a valve deactivator coupled to each engine valve. The valve deactivator includes a means for allowing hydraulic fluid flow to and from each engine valve through the valve control system, and a deactivator means for selectively restricting the flow of hydraulic fluid relative to one of the pair of engine valves to thereby vary the lift of the one engine valve relative to the other engine valve.

Accordingly, it is an object of the present invention to provide an electrohydraulic valvetrain in a four valve engine that only requires one set of valve controls for each pair of intake valves and one for each pair of exhaust valves, yet still assures substantially equivalent lift and timing between each valve within a pair, when required, and can partially or totally deactivate one of the valves in each pair.

An advantage of the present invention is the cost and space savings incurred by coupling the pairs of intake valves together and the pairs of exhaust valves together while still allowing for adjustments between the valves in each pair, to account for manufacturing tolerances, and while allowing for deactivation of one of the valves in each pair.

DETAILED DESCRIPTION OF THE PREFERRED EMBODIMENTS

The present invention provides variable control of engine valve timing, lift and velocity in an engine. The system exploits elastic properties of compressed hydraulic fluid which, acting as a liquid spring, accelerates and decelerates the engine valves during their opening and closing motions. The present invention further provides the ability to operate each pair of intake (or exhaust) valves in a four valve engine with a single set of valve controls to deactivate one of the valves in each pair and to allow for adjustment in lift between the two valves in each pair.

An electrohydraulic valvetrain is shown in detail in U.S. Pat. No. 5,255,641 to Schechter, which is incorporated herein by reference.

Figure 1:
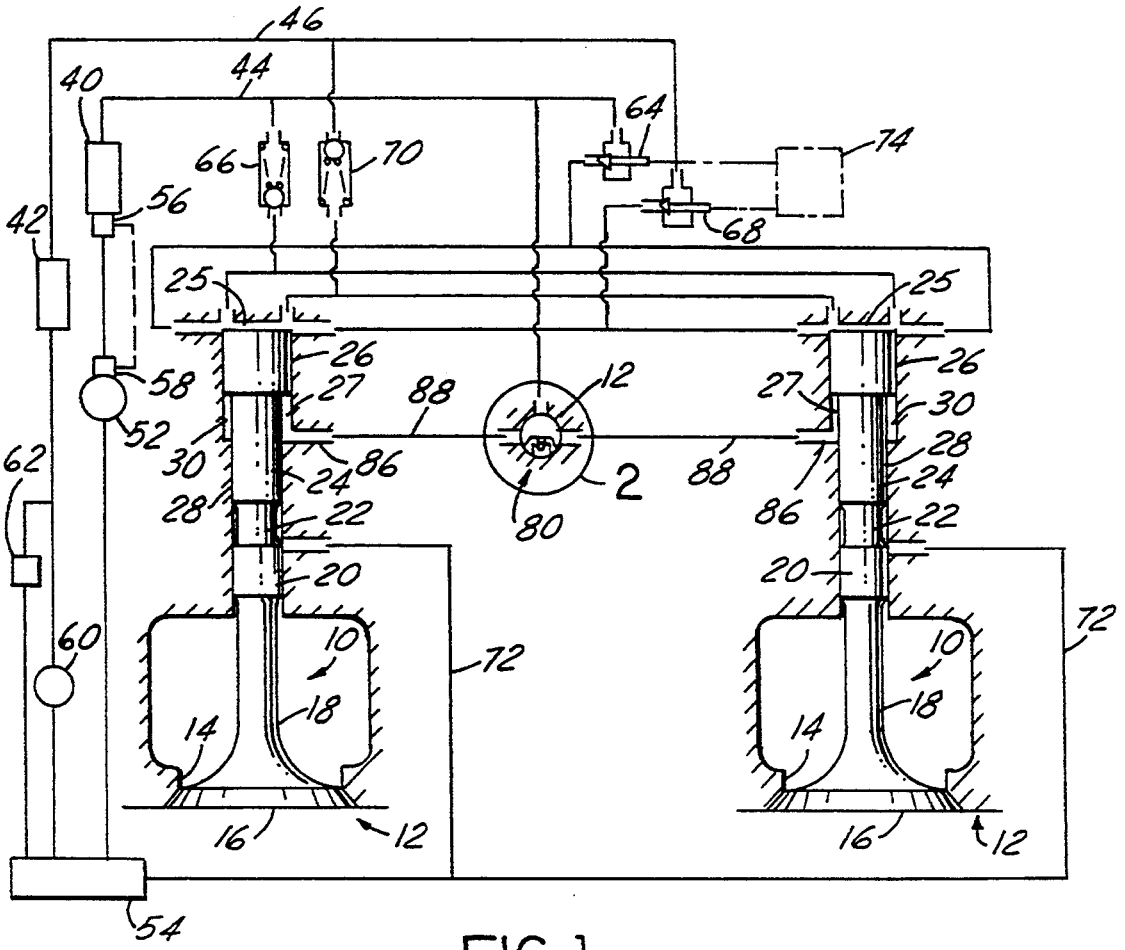
FIG. 1 is a schematic diagram showing a pair of electrohydraulically controlled engine valves in an assembly and a hydraulic system coupled to the pair of engine valves in accordance with the present invention.

In a four valve engine there is a pair of intake valves and a pair of exhaust valves in each cylinder. Since typically it is desirable for the motion of each valve in a pair to be identical, the same valve control system can control a pair of valves acting simultaneously. A diagram of such an arrangement for a pair of valves is shown in FIG. 1. Each solenoid valve and each check valve is connected in an identical way to both engine valves. In such arrangement, activation of a solenoid valve will cause both engine valves to move substantially in unison.

The basic features of the present invention are shown in FIG. 1. Two engine valves 10 are shown connected to the same hydraulic system. The engine valves 10 are located within a cylinder head 12 that includes ports 14, for each valve 10, for inlet air or exhaust, as the case may be. Each valve 10 includes a valve head 16 and stem portion 18. Each valve stem portion 18 includes a series of concentric cylindrical sections 20, 22, 24 and 26 of varying outer diameter. The sections 20 and 24 guide each valve 10 for reciprocation within guide bores 28. Each cylindrical section 26 constitutes a valve piston fixed atop the valve stem portion 18. Each valve piston 26 is slidable within the limits of a piston chamber 30 that is concentric with guide bore 28 and also constitutes a part of the cylinder head 12.

Fluid is selectively supplied to pistons 26 from a high pressure rail 40 and a low pressure rail 42 hydraulically connected through high pressure line 44 and low pressure line 46, respectively.

A hydraulic system for maintaining necessary fluid pressures in the high and low pressure rails is also illustrated in FIG. 1 and includes a variable displacement pump 52 between a reservoir 54 and the high pressure rail 40. Since the fluid in the high pressure rail 40 is subject only to expansion and contraction, the pumping work of the pump 52 is largely limited to that necessary to compensate for internal leakage through clearances. Variable displacement pump 52 may be under automatic control whereby a pressure sensor 56 will produce a pressure feedback signal to a pump controller 58 in the event pressure in the high pressure rail 40 drops below a set minimum required at any particular vehicle speed or other operating condition. This then varies the pump displacement to maintain the required pressure in the high pressure rail 40. Fluid in the low pressure rail 42 is maintained at a fixed low pressure by means of pressure pump 60 supplying fluid from reservoir 54 and pressure regulator 62.

The volume 25 above each piston 26 can be connected to either the high pressure rail 40 through a high pressure actuation valve, such as a solenoid valve 64, or a check valve 66, or the low pressure rail through a low pressure actuation valve, such as a solenoid valve 68, or a check valve 70. The volume 27 below each piston 26 is always connected to the high pressure rail 40. Fluid return lines 72 provide a means for returning to the reservoir 54 any fluid which leaks out of the piston cheers 30.

A solenoid valve control means 74 is electronically connected to the two solenoid valves 64 and 68 to actuate them. The engine valve opening is controlled by the high-pressure solenoid valve 64 that is opened to cause valve acceleration and closed to cause deceleration. Opening and closing of the low pressure solenoid valve 68 controls the valve closing.

During engine valve opening, high pressure solenoid valve 64 opens and the net pressure force acting on pistons 26 accelerates each engine valve 10 downward. High pressure solenoid valve 64 then closes and pressure above pistons 26 drops, and each piston 26 decelerates, pushing the fluid from the volume 27 below it back into high pressure rail 40. Low pressure fluid flowing through check valve 70 prevents void formation in the volumes 25 above the pistons 26 during deceleration. When the downward motion of each valve ceases, low pressure check valve 70 closes and engine valves 10 remain locked in their open position.

The process of valve closing is similar, in principle, to that of valve opening. When low pressure solenoid valve 68 opens, the pressure above each piston 26 drops and the net pressure force acting on each piston 26 accelerates the engine valves 10 upward. The low pressure solenoid valve 68 then closes and the rising pressure above each piston 26 opens the high pressure check valve 66. The engine valves 10 decelerate pushing the fluid from the volumes 25 above the pistons 26 back into the high pressure rail 40. The high pressure check valve 66 closes and the engine valves 10 remain locked in the closed position.

In this system, where a pair of engine valves 10 are operated with one set of hydraulic controls, the system is statically indeterminate. Because of this, a slight difference in tolerances between the two engine valves 10 or in the hydraulic lines can lead to engine valves 10 within a pair that do not have identical opening and closing characteristics. Consequently, the amount and timing of the valve lift can be different for the two valves 10. To account for this, a valve deactivator 80 is located along a portion of the high pressure line 44 leading to the volume 27 below each valve piston 26, as shown in FIGS. 1 and *2a–c*.

The deactivator 80 is shown as a rotatable rod 82 with its axis of rotation perpendicular to the plane of these Figures. The rod 82 is installed in the cylinder head 12 between the two engine valves 10. Somewhere along the length of the rod 82 there is a segment-like-shaped cutout in the rod 82, which forms a communication chamber 84 to which the ports 86 from the volumes 27 below the valve pistons 26 are connected via segments 88 of the high pressure line 44. The communication chamber 84 is always connected to the high pressure rail 40 via high pressure line 44.

Figure 3:
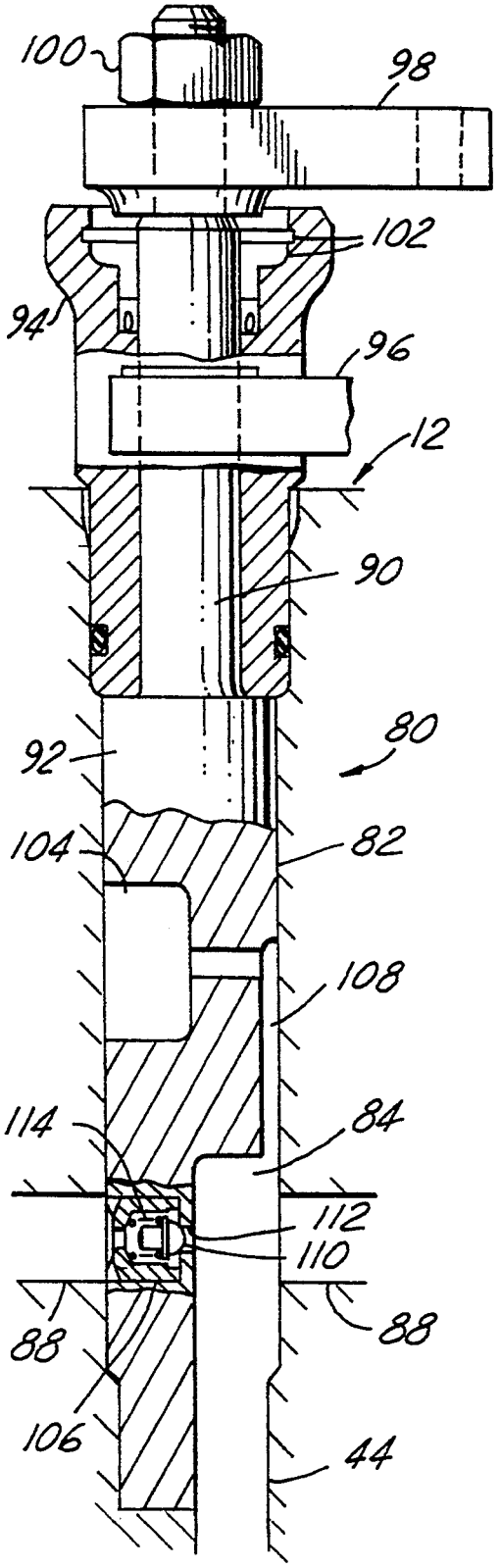
FIG. 3 is a cross-sectional view of a valve deactivator in accordance with the present invention.

FIG. 3 shows the valve deactivator 80 in greater detail. Rotatable rod 82 includes a first smaller diameter portion 90 and a second larger diameter portion 92. The smaller diameter portion 90 is rotatably mounted within a support sleeve 94 that is mounted to the cylinder head 12. A forked support member 96 is coupled to the support sleeve 94 and affixed (not shown) to the cylinder head 12 to retain the deactivator 80 within the cylinder head 12. A lever 98 is threadably mounted to the rod 82 and bearing members 102 by a nut 100, and coupled to an actuator (not shown) for inducing rotation of the deactivator 80.

The larger diameter portion 92 of rod 82 is mounted within cylinder head 12 and includes communication chamber 84, a pressure balancing chamber 104, and has a one way valve 106 mounted within it. Communication chamber 84 is always open to high pressure line 44, and can be selectively open to high pressure line segments 88. Pressure balancing chamber 104 is connected to communication chamber 84 via a conduit 108, which allows balanced pressure to act on either side of the rod 82. A passage 112 connects the communication chamber 84 to the one way valve 106.

One way valve 106 includes a ball member 110 biased against the passage 112 by a spring 114. Thus, when the one way valve 106 is aligned with one of the segments 88 of the high pressure line 44, fluid can enter the segment 88 from the communication chamber 84, but cannot enter the communication chamber 84 from that segment 88.

Figure 2A:
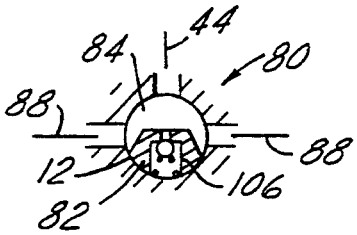
FIG. 2*a* is a view, on an enlarged scale, taken from the encircled area 2 in FIG. 1, with a valve deactivator shown in the fully open position in accordance with the present invention.

The effect of rotating deactivator 80 is shown in FIGS. 1 and 2*a–c*. In FIG. 2*a*, the deactivator 80 is oriented such that neither high pressure line segment 88 is blocked by the one way valve 106 from receiving fluid from communication chamber 84. In this case, both valves 10 will operate substantially in unison.

Figure 2C:
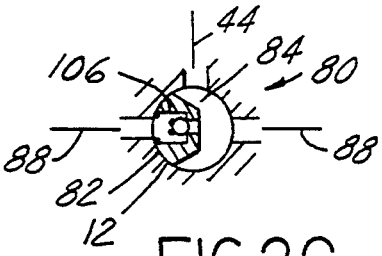
FIG. 2*c* is a view similar to FIG. 2*a* showing a valve deactivator in a fully closed position in accordance with the present invention.
Figure 2B:
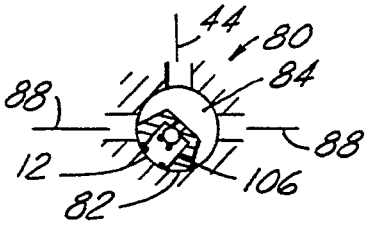
FIG. 2*b* is a view similar to FIG. 2*a* showing a valve deactivator in a partially closed position in accordance with the present invention.

FIG. 2*b* illustrates the valve deactivator 80 in a partially closed position. In this orientation, the rod 82 is turned an amount between 0 degrees and 90 degrees so that the exit of oil from the volume 27 below the left valve piston 26, as seen in FIG. 1, to the communication chamber 84, is partially blocked, throttling the fluid flow from the left valve 10. As a result, the relative motion of left valve 10 will be less than that of the right valve 10. This partial rotation of the deactivator 80, then, can compensate for differences between the two valves 10. If left valve 10 were opening a greater amount than the right valve 10, due to manufacturing tolerances, this partially throttling of the fluid flow can be used to correct for this, allowing for substantially identical valve lift between the two valves 10.

FIG. 2*c* illustrates the valve deactivator 80 in a fully closed position. Deactivator rod 82 is shown rotated 90 degrees clockwise from FIG. 2*a*. In this orientation, the exit of oil from the volume 27 below the left valve piston 26 is blocked by one-way valve 106, but entry of oil into this volume 27 is permitted. This guarantees that whenever the deactivator 80 is in this position the left valve 10 will close and remain closed, while the right valve 10 will continue normal operation. It is clear that if deactivator rod 82 was turned 90 degrees counterclockwise from the position shown in FIG. 2*a*, then right valve 10 would be deactivated while left valve 10 would continue normal operation. Therefore, under certain engine conditions, one of the two engine valves 10 could be deactivated if so desired.

While certain embodiments of the present invention have been described in detail, those familiar with the art to which this invention relates will recognize various alternative designs and embodiments for practicing the invention as defined by the following claims.

We claim:

1. A valve control means for operating hydraulically actuated engine valves for a cylinder of a four valve per cylinder engine, the control means being coupled to a valve control system having a high pressure actuation valve and a low pressure actuation valve, an a valve deactivator coupled to each engine valve, the valve deactivator comprising:

means for allowing hydraulic fluid flow to and from each engine valve through the valve control system; and deactivator means for selectively restricting the flow of hydraulic fluid to one engine valve relative to the other engine valve of a pair of engine valves of a same function for a combustion chamber to thereby vary the lift of the one engine valve relative to the other engine valve.

2. A valve control means according to claim 1 wherein the deactivator means selectively restricts the flow of hydraulic fluid to one engine valve of the pair of engine valves completely, thereby deactivating the one engine valve.

3. A valve control means according to claim 1 wherein the valve control system further includes:

a high pressure source of fluid and a low pressure source of fluid;

a cylinder head member adapted to be affixed to the engine and including an enclosed bore and chamber, the engine valves being shiftable between a first and second position within the cylinder head bore and chamber;

a hydraulic actuator having a pair of valve pistons, one each coupled to a corresponding one of the engine valves and reciprocable within the enclosed chambers which thereby form first and second cavities that vary in displacement as the engine valves move, the high pressure actuation valve and the low pressure actuation valve for respectively regulating the flow of fluid in the first cavities;

a high pressure line extending within the cylinder head between the first and second cavities and the high pressure source of fluid, and a low pressure line extending between the first cavities and the low pressure source of fluid; and control means cooperating with the high and low pressure actuation valves for selectively coupling the first cavities to the high pressure and low pressure source to oscillate the engine valves in timed relation to engine operation.

4. A valve control means according to claim 3 wherein the valve control system includes a hydraulic line connecting the deactivator to the pair of engine valves and the deactivator means comprises:

a rod provided with a communication chamber;

a one way valve mounted within the rod and coupled between the communication chamber and the hydraulic line; and actuator means for variably aligning the one way valve with the hydraulic line.

5. A valve control means according to claim 1 wherein the valve control system includes a hydraulic line connecting the deactivator to the pair of valves and the deactivator means comprises:

a rod provided with a communication chamber;

a one way valve mounted within the rod and coupled between the communication chamber and the hydraulic line; and actuator means for variably aligning the one way valve with the hydraulic line.

6. A hydraulically operated valve control system for an internal combustion engine, the system comprising:

a high pressure source of fluid and a low pressure source of fluid;

a cylinder head member adapted to be affixed to the engine and including an enclosed bore and chamber for each engine valve;

a pair of engine valves of a same function for a combustion chamber shiftable between a first and second position within a respective cylinder head bore and chamber;

a hydraulic actuator having a pair of valve pistons, with each one coupled to a corresponding one of the engine valves and reciprocable within the enclosed chambers which thereby form first and second cavities that vary in displacement as the engine valves move;

a high pressure line extending within the cylinder head between the first and second cavities and the high pressure source of fluid, and a low pressure line extending between the first cavities and the low pressure source of fluid;

a high pressure valve an a low pressure valve for respectively regulating the flow of fluid in the first cavities;

control means cooperating with the high and low pressure valves for selectively coupling the first cavities to the high pressure and low pressure source to oscillate the engine valves in timed relation to engine operation; and deactivator means for variably coupling the pair of engine valves together wherein the lift of one valve may be varied relative to the other.

7. A valve control system according to claim 6 wherein the deactivator means selectively restricts the flow of hydraulic fluid to one engine valve of the pair of engine valves completely, thereby deactivating the one engine valve.

8. A valve control system according to claim 6 wherein the deactivator means comprises:

a rod provided with a communication chamber;

a one way valve mounted within the rod and coupled between the communication chamber and the hydraulic line; and actuator means for variably aligning the one way valve with the hydraulic line.

9. A hydraulically operated valve control system for an internal combustion engine, the system comprising:

a high pressure source of fluid and a low pressure source of fluid;

a cylinder head member adapted to be affixed to the engine and including an enclosed bore and chamber for each engine valve;

a pair of engine valves of a same function for a combustion chamber shiftable between a first and second position within respective cylinder head bore and chamber;

a hydraulic actuator having a pair of valve pistons, with each one coupled to a corresponding one of the engine valves and reciprocable within the enclosed chambers which thereby form first and second cavities that vary in displacement as the engine valves move;

a high pressure line extending within the cylinder head between the first and second cavities and the high pressure source of fluid, and a low pressure line extending between the first cavities and the low pressure source of fluid;

a high pressure valve and a low pressure valve for respectively regulating the flow of fluid in the first cavities;

control means cooperating with the high and low pressure valves for selectively coupling the first cavities to the high pressure and low pressure source to oscillate the engine valves in timed relation to engine operation; and deactivator assembly, for variably coupling the pair of engine valves together, having a rod provided with a communication chamber, a one way valve mounted within the rod and coupled between the communication chamber and the hydraulic line, and actuator means for variably aligning the one way valve with the hydraulic line wherein the lift of one valve may be varied relative to the other.

10. A valve control system according to claim 9 wherein the deactivator assembly selectively restricts the flow of hydraulic fluid to one engine valve of the pair of engine valves completely, thereby deactivating the one engine valve.

* * * * *